US005192155A

United States Patent [19]

Meyer

[11] Patent Number: 5,192,155

[45] Date of Patent: Mar. 9, 1993

[54] MAGNETIC GRIPPER DEVICE

[75] Inventor: Ross E. Meyer, Los Alamos, N. Mex.

[73] Assignee: The United States of America as represented by the United States Department of Energy, Washington, D.C.

[21] Appl. No.: 870,965

[22] Filed: Apr. 20, 1992

[51] Int. Cl.[5] ..... B25G 3/12

[52] U.S. Cl. ..... 403/410; 403/DIG. 1; 52/DIG. 4; 36/1; 248/206.5

[58] Field of Search ..... 403/410, DIG. 1; 248/925, 206.5, 309.4; 182/133, 134–136; 335/285, 293; 269/8; 36/132, 136, 116, 1; 52/DIG. 4

[56] References Cited

U.S. PATENT DOCUMENTS

| | | | |
|---|---|---|---|
| 3,031,778 | 5/1962 | Nicholson et al. | 52/DIG. 4 X |
| 3,304,111 | 2/1967 | Kauh et al. | 52/DIG. 4 X |
| 3,895,330 | 5/1975 | Yost | 335/285 X |
| 4,934,119 | 6/1990 | Ybarra | 52/DIG. 4 X |

FOREIGN PATENT DOCUMENTS

| | | | |
|---|---|---|---|
| 884672 | 11/1981 | U.S.S.R. | 36/1 |

*Primary Examiner*—Randolph A. Reese
*Assistant Examiner*—Harry C. Kim
*Attorney, Agent, or Firm*—Ray G. Wilson; Paul D. Gaetjens; William R. Moser

[57] ABSTRACT

A climbing apparatus is provided for climbing ferromagnetic surfaces, such as storage tanks and steel frame structures. A magnet assembly is rotatably mounted in a frame assembly. The frame assembly provides a pair of cam surfaces having different dimensions so that, when the frame is rotated, the cam surfaces contact the ferromagnetic surface to separate the magnet assembly from the surface. The different cam dimensions enable one side of the magnet at a time to be detached from the surface to reduce the effort needed to disengage the climbing apparatus. The cam surface also provides for smoothly attaching the apparatus. A hardened dowel pin is also attached to the frame and the pointed end of the dowel engages the surface when the magnet is attached to the surface to prevent downward sliding movement of the assembly under the weight of the user.

6 Claims, 1 Drawing Sheet

MAGNETIC GRIPPER DEVICE

This invention is the result of a contract with the Department of Energy Contract No. W-7405-ENG-36).

BACKGROUND OF THE INVENTION

This invention generally relates to gripping and holding devices and, more particularly, to magnetic gripping and holding devices for use with ferromagnetic structures.

There is occasionally a need to climb metal structures where the structures have not been designed with hand holds, foot holds, and the like, to assist a person in climbing the structure. If the material is a ferromagnetic material, a magnetic attachment might be used to support a climber. High magnetic forces are required, however, to hold a climber on a vertical ferromagnetic metal surface against the force of gravity. High magnetic forces make the magnet hard to release from the ferromagnetic surface. Magnetic devices might be designed with magnetic "short circuits" for releasing the magnets from the surface, but designs incorporating such short circuits are heavy and bulky and unsuitable for use in many locations. It will also be appreciated that a single climber needs to be able to engage and release a climbing device from the surface using a single hand or foot so that climbing can be done in a hand-over-hand operation.

The present invention addresses these issues and an improved magnetic gripper assembly is provided for use in scaling vertical ferromagnetic metal surfaces. Accordingly, it is an object of the present invention to provide a magnetic gripper assembly that is easily transported by a user.

It is another object of the present invention to provide a magnetic gripper assembly that is easy to release from a ferromagnetic material surface.

One other object of the present invention is to provide a magnetic gripper assembly that attaches smoothly to a ferromagnetic material surface.

A further object of the present invention is to provide a magnetic gripper assembly that can be installed or removed using only one hand or a foot.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, this invention may comprise apparatus for releasable attachment to a ferromagnetic surface. A magnet means adheres to the ferromagnetic surface. A frame is rotatably attached to the magnet means, where the frame defines at least one cam surface having a first dimension effective for placing the magnet means against the ferromagnetic surface and a second dimension effective to detach said magnet means from the ferromagnetic surface. In one embodiment of the invention, the at least one cam surface is first and second cam surfaces where the first cam surface has a second dimension greater than the second dimension of the second cam surface.

BRIEF DESCRIPTION OF THE DRAWINGS

The accompanying drawings, which are incorporated in and form a part of the specification, illustrate an embodiments of the present invention and, together with the description, serve to explain the principles of the invention. In the drawings.

DETAILED DESCRIPTION OF THE INVENTION

Figure 1:
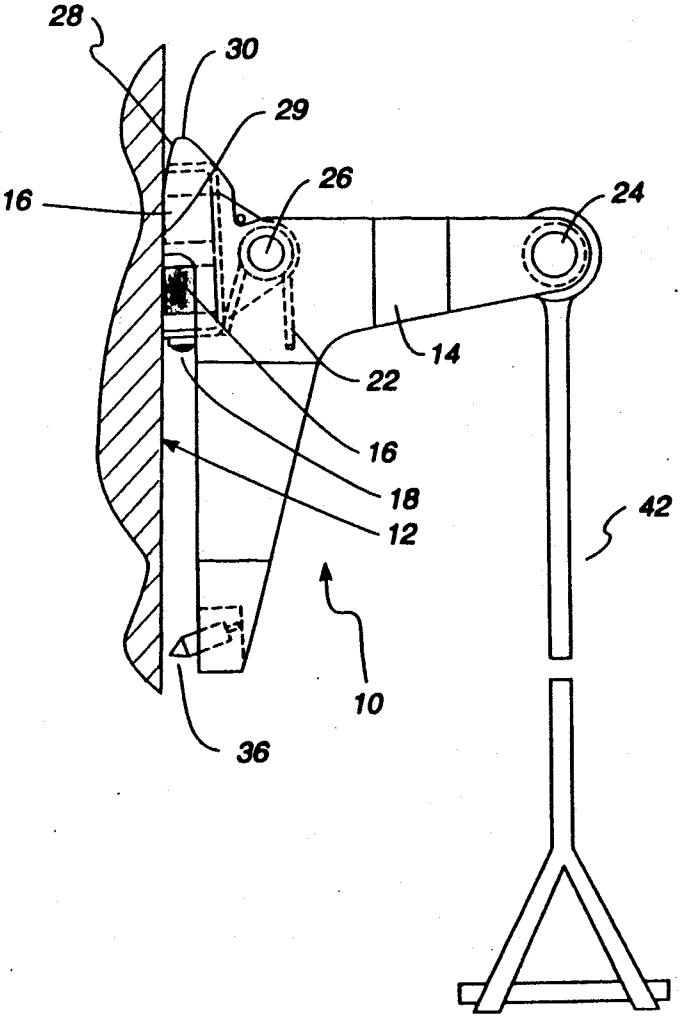
FIG. 1 is a side view of one embodiment of the invention with the magnet adhered to a ferromagnetic surface.

Referring first to FIG. 1, there is shown one embodiment of a device for use in climbing along ferromagnetic surfaces, such as storage tanks, steel frames, and the like, where hand holds and foot holds are not available. Gripper assembly 10 includes magnet 16 mounted within magnetic holder 18 and rotatably supported on pivot pin 26 within frame 14. As shown in FIG. 1, frame 14 is rotated about pivot pin 26 to move cam surface 28 to a first dimension 29 adjacent surface 12 effective to adhere magnet 16 to surface 12 from a second dimension 30 effective for cam surface 28 to hold magnet 16 detached from surface 12. First dimension 29 and second dimension 30 are the radial distances of the respective cam surface 28 from the axis of pivot pin 26. Frame 14 is preferably "L" shaped with a lever arm supporting handle 24 for gripping and rotating cam surface 28 along surface 12 and a depending arm having dowel pin 36 secured at the arm extremity. As magnet 16 adheres to surface 12, frame 14 continues to rotate to bring dowel pin 36 into mechanical engagement with surface 12.

It will be appreciated that the coefficient of friction between the surface of magnet 16 and ferromagnetic surface 12 can be highly variable depending on the condition of surface 12, i.e., painted, wet, oxidized, etc. Further, the strength of magnet 16 is preferably minimized to permit easy removal by cam surface 28, as hereinafter explained, as a user climbs along the surface. Accordingly, dowel pin 36 is provided to assist magnet 16 in preventing downward sliding motion of gripper assembly 10 along surface 12. Dowel pin 36 preferably has a pointed end that can indent and engage surface 12 and assist magnet 16 if sliding movement of gripper assembly 10 begins along surface 12. Thus, magnet 16 has sufficient strength to adhere gripper assembly 10 to surface 12 and, along with dowel pin 36, to prevent downward sliding movement of gripper assembly 10. By way of example, satisfactory climbing along a painted ferromagnetic surface has been carried out with a magnet 16 exerting an adherent force of about 325 lbs and with a pointed hardened dowel pin 36 of stainless steel.

Figure 2:
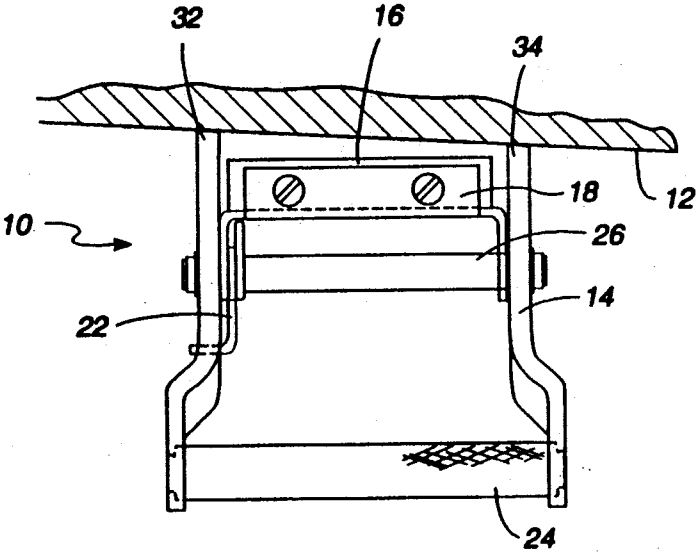
FIG. 2 is a top view of one embodiment of the present invention with the magnet displaced from a ferromagnetic surface.

Referring now to FIG. 2, there is shown a top view of gripper assembly 10 as magnet 16 is disengaged from surface 12. Cam surfaces 32 and 34 provide sufficient mechanical advantage to detach magnet 16 from surface 12. Cam surfaces 32 and 34 also enable magnet 16 to be placed adjacent surface 12 with cam surfaces 32 and 34 having a second dimension as defined in FIG. 1 effective to hold magnet 16 off surface 12. As frame 14 is rotated, the dimensions of cam surfaces 32 and 34 change to smoothly bring magnet 16 into contact with surface 12 without sudden movement of magnet 16 against surface 12. Spring 22 is provided to maintain magnet 16 positioned within frame 14 for attachment to surface 12.

In a preferred embodiment, cam surfaces 32 and 34 have different second dimensions for detaching magnet 16. It has been found that uneven cam surfaces enables a user to detach magnet 16 more easily than if the cam surfaces are of equal dimensions. As frame 14 is rotated upward, cam surfaces 32 and 34 enable one side of the magnet at a time to be detached from surface 12 until magnet 14 is completely detached.

Magnet 16 includes a pair of NdFe permanent magnets sandwiched between C1006 steel spacers for contacting surface 12. The permanent magnets and spacers are fastened within stainless steel holder 18 that is, in turn, supported by pivot pin 26. Frame 14 is formed from a nonmagnetic material that is preferably light weight, such as aluminum or a high strength plastic.

To establish movement along a ferromagnetic surface, a user of gripper assembly 10 first places cam surfaces 32 and 34 against surface 12 with second cam dimensions for spacing magnet 16 from surface 12. A user can grip handle 24 and rotate frame 14 downward to decrease the cam dimension contacting surface 12 to the first cam dimension and bring magnet 16 into adhering contact with surface 12. As the weight of the user is applied to frame 14, frame 14 then continues to rotate downward to bring dowel pin 36 into contact with surface 12. A second gripper assembly 10 is placed above the first assembly and the user can alternate gripper assembly attachment and detachment from surface 18 to effect a climbing movement up the surface.

Figure 3:
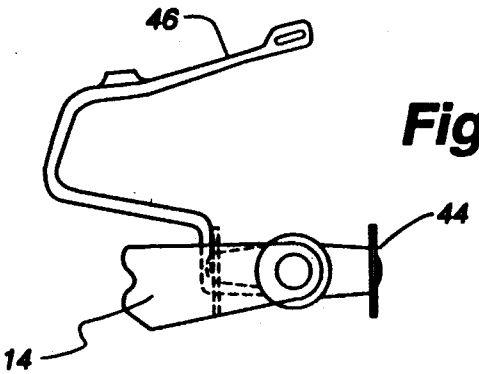
FIG. 3 is a partial side view of the device shown in FIG. 1 adapted for foot actuation.

In one embodiment, a foot sling 42 can be attached to handle 24 so that the user can stand and be supported by one gripper 10 while relocating another gripper 10. Alternatively, frame 14 may be provided with an attachment to enable actuation by foot action, as shown in FIG. 3. Foot grip 44 with foot clamp 46, which may be similar to a bicycle pedal, may be fastened to frame 14 so that the user can simply engage frame 14 with a foot and use foot action to detach and reattach a gripper assembly to surface 12. A user can then use a gripper 10 in each hand and provide a gripper 10 for each foot to easily move up surface 12.

The foregoing description of preferred embodiments of the invention have been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. Apparatus for releasable attachment to a ferromagnetic surface, comprising:

magnet means for adhering to said ferromagnetic surface;

a frame rotatably attached to said magnet means; and cam means defined by said frame having a first dimension effective for placing said magnet means against said ferromagnetic surface and a second dimension effective to detach said magnet means from said ferromagnetic surface, where the spacing of said magnet means from said ferromagnetic surface varies as said cam means is rotated by said frame on said ferromagnetic surface between said first and said second dimensions.

2. Apparatus according to claim 1, wherein said cam means includes first and second cam surfaces spaced apart by said magnet means, said first cam surface having said second dimension greater than said second dimension of said second cam surface.

3. Apparatus according to claim 2, wherein said frame includes pin means for mechanically engaging said ferromagnetic surface when said magnet means is adhered to said ferromagnetic surface.

4. Apparatus according to claim 2, further including spring means contacting said magnet means and said frame for maintaining said magnet means positioned within said frame as said first and second cam surfaces rotate between said first and second dimensions.

5. Apparatus according to claim 1, wherein said frame includes pin means for mechanically engaging said ferromagnetic surface when said magnet means is adhered to said ferromagnetic surface.

6. Apparatus according to claim 1, further including spring means contacting said magnet means and said frame for maintaining said magnet means positioned within said frame as said at least one cam surface rotates between said first and second dimensions.

* * * * *